US010173343B2

(12) United States Patent
Jones et al.

(10) Patent No.: US 10,173,343 B2
(45) Date of Patent: Jan. 8, 2019

(54) SLURRY DISTRIBUTION SYSTEM WITH VIBRATION ISOLATION

(71) Applicant: UNITED STATES GYPSUM COMPANY, Chicago, IL (US)

(72) Inventors: Frederick T. Jones, Grayslake, IL (US); Brad Todd, Hainesville, IL (US); William J. Rago, Gurnee, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 223 days.

(21) Appl. No.: 15/186,027

(22) Filed: Jun. 17, 2016

(65) Prior Publication Data

US 2017/0361493 A1 Dec. 21, 2017

(51) Int. Cl.

| | |
|---|---|
| ***B28C 5/48*** | (2006.01) |
| ***B01F 15/02*** | (2006.01) |
| ***B28C 7/16*** | (2006.01) |
| ***B28B 1/08*** | (2006.01) |
| ***B28B 19/00*** | (2006.01) |

(52) U.S. Cl.

CPC ..... *B28C 5/48* (2013.01); *B01F 15/0298* (2013.01); *B28B 1/081* (2013.01); *B28B 19/0092* (2013.01); *B28C 7/162* (2013.01); *B01F 2215/0047* (2013.01)

(58) Field of Classification Search

USPC ..... 366/42

See application file for complete search history.

(56) References Cited

U.S. PATENT DOCUMENTS

| | | | |
|---|---|---|---|
| 2,854,130 | A | 9/1958 | Adams |
| 2,935,177 | A | 5/1960 | Morris |
| 3,087,603 | A | 4/1963 | Petrea |

(Continued)

FOREIGN PATENT DOCUMENTS

| | | | | |
|---|---|---|---|---|
| SU | 1224141 | * | 4/1986 | ..... B28B 1/08 |
| WO | WO-2015186032 | A1 | 12/2015 | |

OTHER PUBLICATIONS

SU 1224141, Zykov et al., Apr. 1986, machine translation.*

(Continued)

*Primary Examiner* — Mark Halpern

(74) *Attorney, Agent, or Firm* — Marshall, Gerstein & Borun LLP

(57) ABSTRACT

A cementitious slurry mixing and dispensing system includes a slurry mixer that agitates and forms aqueous cementitious slurry, a discharge conduit in communication with the mixer and forming an interior surface defining a slurry flow path to convey the slurry therethrough to an outlet, a distribution mat disposed proximally to the outlet, a vibrating plate supporting the distribution mat, an overhead bracing system from which the vibrating plate is suspended, and a plurality of support members coupled between the overhead bracing system and the vibrating plate. The vibrating plate is adapted to impart vibrational forces on the distribution mat to promote movement of the aqueous slurry. Each support member includes a rod, a hollow coupling member, and at least one resilient bushing assembly adapted to dampen the vibrational forces exerted by the vibrating plate, thereby isolating the rod and the overhead bracing system from the vibrational forces.

19 Claims, 3 Drawing Sheets

(56) References Cited

U.S. PATENT DOCUMENTS

| | | | | |
|---|---|---|---|---|
| 3,203,264 | A | 8/1965 | Evans | |
| 3,301,385 | A | 1/1967 | Lambert | |
| 3,703,233 | A | 11/1972 | Hacker | |
| 3,917,236 | A * | 11/1975 | Hanson | B28C 5/34 366/49 |
| 4,503,792 | A | 3/1985 | Cook | |
| 4,768,647 | A | 9/1988 | Lehtola | |
| 5,547,068 | A | 8/1996 | Spurlin | |
| 5,833,205 | A | 11/1998 | Lindbeck | |
| 5,873,565 | A | 2/1999 | Allaire | |
| 6,155,277 | A * | 12/2000 | Barry | B01F 13/0035 134/104.4 |
| 6,536,750 | B1 | 3/2003 | Martin | |
| 6,866,047 | B1 * | 3/2005 | Marvin | B01F 13/0035 134/111 |
| 7,086,522 | B2 | 8/2006 | Schmidt | |
| 8,517,168 | B2 | 8/2013 | Hufford | |
| 9,169,076 | B2 | 10/2015 | Schultheis | |
| 2003/0202418 | A1 * | 10/2003 | Scartezina | B28C 5/4203 366/44 |
| 2004/0241271 | A1 | 12/2004 | Derusco et al. | |
| 2007/0045892 | A1 * | 3/2007 | Sucech | B28B 19/0092 264/171.13 |
| 2012/0168527 | A1 | 7/2012 | Li et al. | |
| 2013/0098268 | A1 | 4/2013 | Li et al. | |
| 2015/0024228 | A1 * | 1/2015 | Li | B28B 7/46 428/537.7 |
| 2015/0231799 | A1 | 8/2015 | Wittbold et al. | |

OTHER PUBLICATIONS

McMaster.com, "Versa-Mount Vibration-Damping Mount," (2016). Retrieved from the Internet on Jun. 30, 2016: URL: http://www.mcmaster.com/#6309k34.

International Search Report and Written Opinion for International Application No. PCT/US2017/037215, dated Oct. 13, 2017.

Database WPI, Thomson Scientific, London, GB, Week 198650, XP002773598, Apr. 15, 1986.

* cited by examiner

SLURRY DISTRIBUTION SYSTEM WITH VIBRATION ISOLATION

FIELD OF THE DISCLOSURE

The present disclosure generally relates to production of wallboard and, more particularly, to devices for managing vibrations in a production machine.

BACKGROUND

In many types of cementitious articles, set gypsum (calcium sulfate dehydrate) is often a major constituent. For example, set gypsum is a major component of end products created by use of traditional plasters (e.g., plaster surfaced internal building walls), and also in faced gypsum board employed in drywall construction of interior walls and ceilings of buildings. Typically, such gypsum-containing cementitious products are made by preparing a mixture of calcined gypsum (calcium sulphate alpha or bet hemihydrate and/or calcium sulfate anhydrite), water, and other components, as desired, to form cementitious slurry.

Typically, a cementitious article such as wallboard or gypsum board is manufactured by uniformly dispersing calcined gypsum in water to form an aqueous calcined gypsum slurry. This slurry is typically produced in a continuous manner by inserting the calcined gypsum, water, and other additives into a mixer which contains any number of apparatuses for agitating the contents to form a uniform gypsum slurry. The slurry is directed toward and through a discharge outlet of the mixer and into a discharge conduit. A stream of slurry passes through the discharge conduit and out of a distribution mat supported by a forming table. As the slurry passes through the distribution mat and onto a conveyor belt, it is evenly distributed therethrough. The slurry then travels on the conveyor belt for further processing and/or to be formed as a final wallboard product. In some known systems, the system can include components that impart vibrational forces on the distribution mat to ensure the slurry does not get stuck or clogged. Depending on the construct of the system, however, repeated application of vibratory forces can damage the mechanical components and connections.

SUMMARY

In accordance with one or more aspects, systems and approaches for mounting components in a slurry distribution system may address the need for a strong and effective device. These components can provide isolation control for extended periods of time before failure, thereby allowing the system to operate in an efficient manner. Components in the system can be easily swappable, thus requiring little downtime in the event of material failures. Further, components can be constructed and arranged in a way that, in the event of component failure, still provides support for all system components, thus reducing or eliminating the occurrence of damage to sensitive components.

In accordance with a first exemplary aspect, a cementitious slurry mixing and dispensing system may include a slurry mixer adapted to agitate a cementitious material and water to form aqueous cementitious slurry, a discharge conduit in fluid communication with the slurry mixer, the discharge conduit forming an interior wall surface defining a slurry flow path which conveys aqueous cementitious slurry therethrough to an outlet, a distribution mat disposed proximally to the outlet of the discharge conduit, a vibrating plate supporting the distribution mat, the vibrating plate adapted to impart vibrational forces on the distribution mat to promote movement of the aqueous cementitious slurry therethrough, an overhead bracing system from which the vibrating plate is suspended, and a plurality of support members coupled between the overhead bracing system and the vibrating plate. In many forms, the discharge conduit is constructed from a resilient material. The distribution mat is adapted to evenly distribute the aqueous cementitious slurry onto a moving conveyor belt.

In these forms, each of the support members includes a rod, a hollow coupling member, and at least one resilient bushing assembly. An upper end portion of the rod is fixed to the overhead bracing system and a lower end portion of the hollow coupling member is coupled to the vibrating plate. The resilient bushing assembly is mounted between the lower end of the rod and the upper portion of the hollow coupling member. The resilient bushing assembly is adapted to dampen the vibrational forces exerted by the vibrating plate, thereby isolating the rod and the overhead bracing system from the vibrational forces.

The resilient bushing assembly can include an outer bumper constructed of a resilient material and an inner core. The outer bumper defines an opening therethrough, and the inner core is disposed therein. The inner core constructed of a rigid material. In some examples, the inner core is adapted to maintain the distribution mat at the desired vertical orientation if the outer bumper experiences a material failure. The resilient bushing assembly can also include any number of components such as support washer disposed below the upper portion of the hollow coupling member to provide an additional form of support.

BRIEF DESCRIPTION OF THE DRAWINGS

The above needs are at least partially met through provision of the slurry distribution system isolation mounting system described in the following detailed description, particularly when studied in conjunction with the drawings, wherein.

The figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Figure 1:
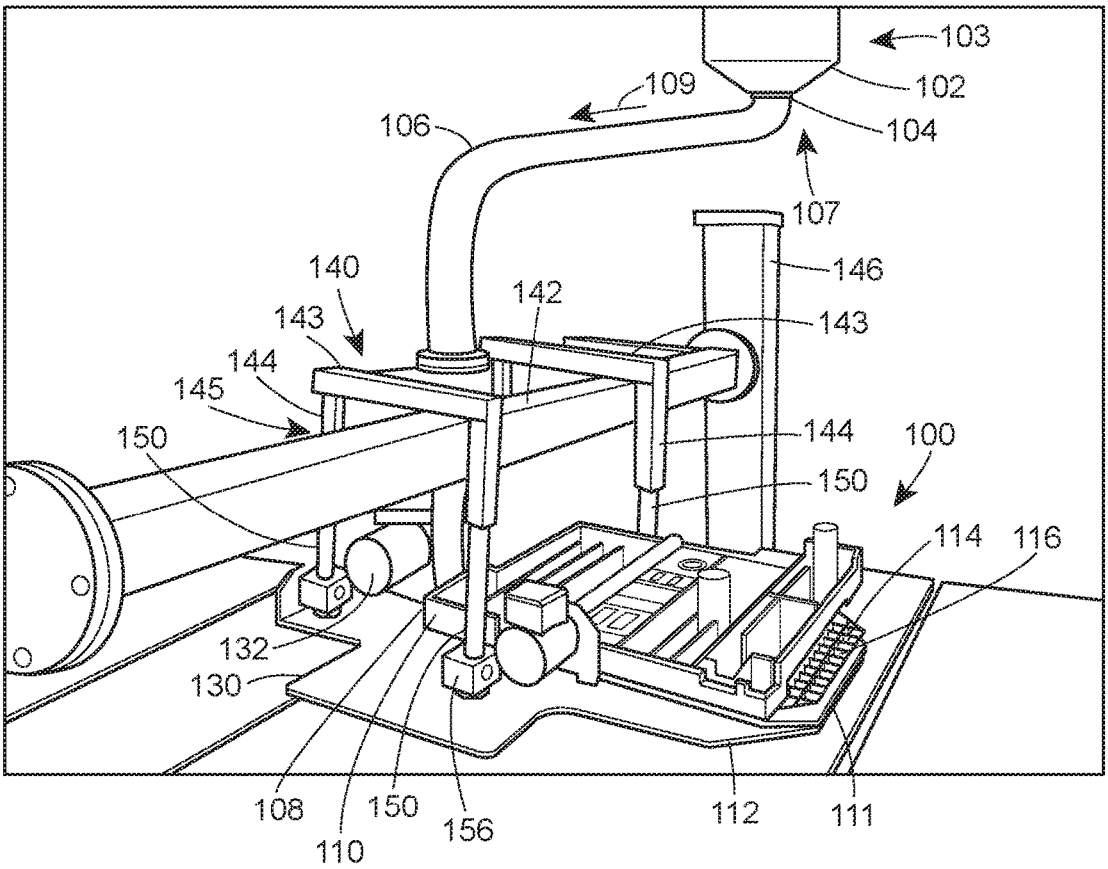
FIG. 1 comprises a perspective view of an exemplary slurry distribution system using an isolation mounting support member in accordance with various embodiments of the invention.

Generally speaking, the present disclosure relates to a slurry distribution system (SDS) 100 for manufacturing wallboard (e.g., drywall) panels and, also an isolation mounting system 150 for the SDS 100. As illustrated in FIG. 1, the SDS 100 includes a slurry mixer 102, a discharge conduit 106, a distribution mat, pouch, or bladder 110, a vibrating plate 130, an overhead bracing system 140, and any number of isolation mounting systems or support members 150. The system 100 can include any number of additional components and/or subsystems known to those having skill in the art and will not be described herein for the sake of brevity. Some examples of SDSs and SDS components that may be part of the SDS 100 of the present disclosure are disclosed in U.S. Publication No. 2012/0168527; U.S. Publication No. 2013/0098268; and U.S. Publication No. 2015/0231799, the contents of which are herein incorporated by reference in their entirety.

The slurry mixer 102 can be any type of mixer (e.g., a pin mixer, a paddle mixer, an auger mixer, a vibratory mixer, a barrel mixer, etc.) adapted to agitate and combine a number of ingredients to form an aqueous cementitious slurry. Other examples of mixers are possible. The slurry mixer 102 includes an inlet 103 for receiving the ingredient or ingredients, an outlet 104 for transferring the ingredients therefrom, and a flow path extending between the inlet 103 and the outlet 104. The mixer 102 can also include any number of mixing apparatuses therein such as a number of paddles and/or blades to assist in mixing any materials added thereto. In some examples, the mixer 102 may use any number of augers or rotating screws to incorporate and mix the materials. Other examples as well as combinations of these examples of mixing apparatuses are possible. The mixing apparatus contained in the slurry mixer 102 may be mounted in any number of configurations (such as, for example, horizontally or vertically) which are disposed in the flow path.

The materials can be supplied to the slurry mixer 102 at the inlet 103 via one or more feeding tanks, inlets, hoppers, conveyors, or other devices as known in the art. Examples of materials can include a cementitious material, water, additives, and any number of additional ingredients. In some examples, the ingredients include any number of minerals, pigments, starches, thickeners, anti-bacterial, dyes, and other commonly known materials. The wet ingredients 104 can include water, latex, defoamers, dispersants, as well as any other commonly known materials. It is understood that in some examples, a subset of materials may be separately fed to the system 100 after the mixed composition exits the outlet 104. For example, a defoamer may be added to the mixed composition after the ingredients have been mixed together to form the mixed composition.

The discharge conduit 106 includes an inlet 107 in fluid communication with the outlet 104 of the mixer 102 and an outlet 108. The discharge conduit 106 can be constructed of a material such as, for example, PVC or urethane. Other examples are possible. The discharge conduit 106 extends in a longitudinal direction and has a sidewall portion and an interior wall surface (not shown). The interior wall surface defines a slurry passage or flow path 109 which conveys the aqueous cementitious slurry therethrough. The discharge conduit 106 can be bifurcated or otherwise split into a number of distinct parallel tubes which may be separated or joined at any point along the flow path 109. Any suitable approach for forming the discharge conduit 106 can be used. For example, a multi-piece mold can be used to make the conduit 106 from a flexible material. Other examples are possible.

The distribution mat 110 is disposed proximal to the outlet 108 of the discharge conduit 106. The distribution mat 110 can be a bladder or pouch having an open end 111 allowing the slurry to exit therethrough in a manner described herein. The distribution mat 110 receives the aqueous cementitious slurry from the discharge conduit 106 and evenly distributes the slurry onto the moving conveyor belt 112.

A grate or upper plate 114 can be adjustably disposed above the distribution mat 110. The grate 114 acts to prevent the distribution mat 110 from expanding in a vertical direction, and thus maintains the distributed slurry at a uniform thickness as it exits the outlet 111. The grate 114 can include webbing or openings 116 having any desired shape, size, and orientation and allows the distribution mat 110 to be slightly deformed to reduce the possibility of the slurry becoming stuck or clogged upon exiting the distribution mat 110.

The vibrating plate 130 can be constructed of any suitable material such as, for example, steel, aluminum, plastic, or other metals. The vibrating plate is operably coupled to support the distribution mat 110 and can include any number of motors 132 such as vibrators, agitators, or other devices capable of imparting a vibratory force on the distribution mat 110 to assist with maintaining a continuous flow of slurry therethrough. The vibrating plate 130 can include any number of coupling portions disposed along an outer perimeter thereof.

The overhead bracing system 140 can include any type of support system, and is adapted to support the distribution mat 110, the grate 114, the vibrating plate 130, and any other desired components. The overhead bracing system 140 can be constructed from high-strength materials such as steel, titanium, aluminum, and the like. Other examples are possible. In the example illustrated in FIG. 1, the overhead bracing system 140 includes a central cross-member 142 and a number of lateral arms 143 extending therefrom. Each arm 143 includes a vertical support 144 depending downwardly therefrom and having a receiving end 145 that receives the support member 150. The central cross-member 142 is coupled to a vertical post 146 which can then be fixed to the ground of the environment, for example, for a solid foundation. In other examples, the overhead bracing system 140 can be mounted using any number of additional components and/or techniques known to those skilled in the art.

Figure 2:
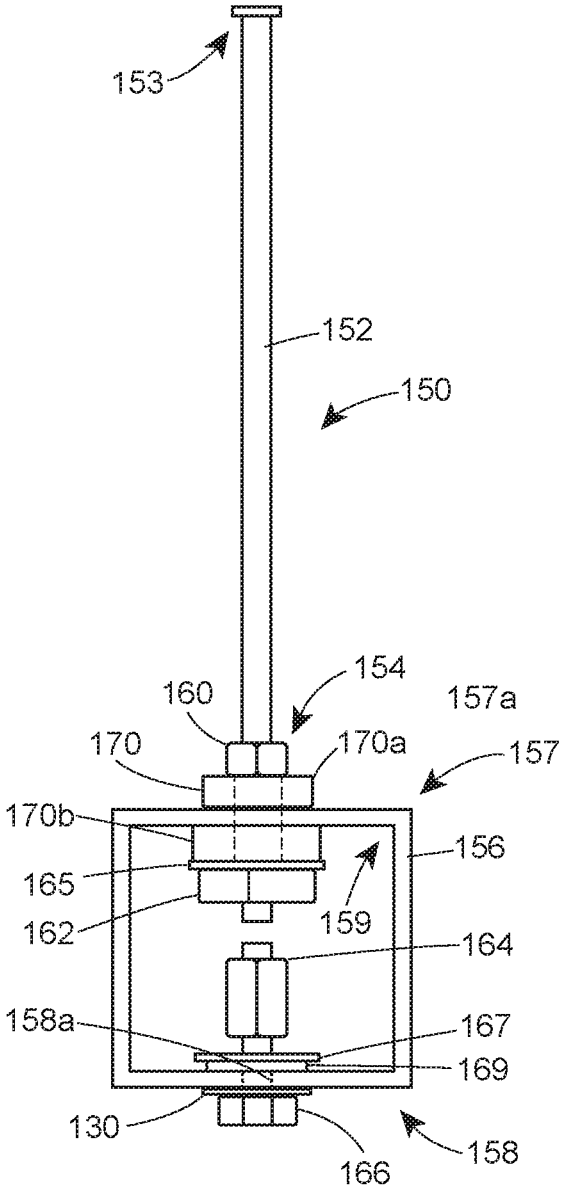
FIG. 2 comprises a front elevation view of an exemplary support member of the slurry distribution system of FIG. 1 in accordance with various embodiments of the invention.

As shown in FIG. 2, each support member 150 can include a rod 152 having an upper end 153 and a lower end 154, a hollow coupling member 156 having an upper portion 157 and a lower portion 158, and a resilient bushing assembly 170. The rod 152 can be constructed of any suitable material such as steel or aluminum. In some examples, all or a portion of the rod 152 can be threaded and thus can be threadably inserted into the receiving end 145 of the vertical support 144. Any length of the rod 152 can be inserted into the receiving end 145 of the vertical support 144, thus the overall length of the support member 150 is variable as desired. It is understood that the upper end 153 of the rod 152 can be coupled to the vertical support 144 using type of known connector. In one example, the overall length of the support member 150 can be adjusted between approximately 3 inches and 30 inches. Other lengths are possible.

The hollow coupling member 156 can be constructed of any suitable material such as, for example, steel or other metals. As illustrated in FIG. 2, the hollow coupling member 156 can be generally rectangular when viewed from a front elevation view. In alternative embodiments, the cross section of the hollow coupling member 156 may have a shape other than rectangular. For example, the hollow coupling member 156 can have a circular, parabolic, ovaloid, triangular, trapezoidal, or any other shape. The top and bottom portions 157, 158 of the hollow coupling member 156 have a central hole or opening 157*a*, 158*a*, respectively. The opening 157*a* in the top portion 157. The opening 158*a* in the bottom portion 158 is dimensioned appropriately to accept a fastener 166, as will be discussed below. In some embodiments, the corners 159 of the hollow coupling member 156 may be curved, chamfered, or otherwise angled to reduce the occurrence of material failure at these locations.

Figure 4:
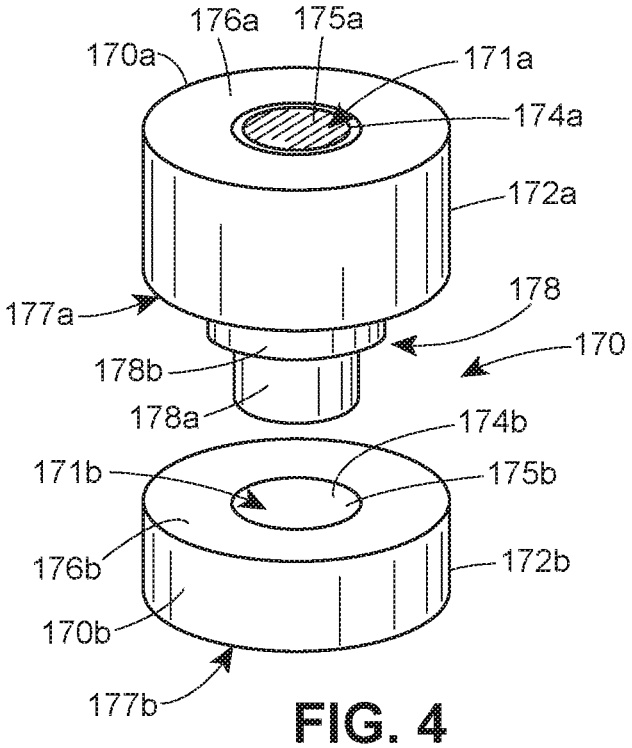
FIG. 4 comprises a perspective view of an exemplary resilient bushing assembly of the slurry distribution system of FIGS. 1-3 in accordance with various embodiments of the invention.

As shown in FIG. 4, the resilient bushing assembly 170 can be constructed from one or more portions. The resilient bushing assembly 170 in the depicted version includes a first portion 170*a* and a second portion 170*b*. Here, the first portion 170*a* is positioned above the second portion 170*b* relative to the orientation of FIG. 4. In other examples, the portions 170*a*, 170*b* of the resilient bushing assembly 170 may be separate and not coupled to each other, or the bushings may be entirely separate components, or the bushing assembly may be a one-piece integral component.

The first portion 170*a* can include an outer bumper 172*a* constructed of any number of resilient materials such as, for example, rubbers, polymers, cork, foam, or any other suitable material having dampening capabilities. The outer bumper 172*a* defines a through bore 171*a* extending between a top surface 176*a* and a bottom surface 177*a* thereof. An inner core 174*a* constructed of a rigid material (such as, for example, steel or other metals) is disposed in the bore 171*a*. This inner core 174*a* itself defines a central bore 175*a* that extends coaxially with the through bore 171*a* of the outer bumper 172*a* and has a cylindrical shape through which the rod 152 can pass. In some examples, the resilient bushing assembly 170 may not include an inner core 174, and the rod 152 passes directly through the bore 171*a* in the bumper 172*a*. As shown in FIG. 4, the first portion 170*a* of the bushing assembly 170 of the present version may also include an inner portion 178 consisting of a first segment 178*a* and a neck or shoulder portion 178*b* extending beneath the outer bumper 172*a*. In some versions, the inner portion 178 can be part of the outer bumper 172*a*, the inner core 174*a*, or both.

The second portion 170*b* of the resilient bushing assembly 170 can also include an outer bumper 172*b* which defines a through bore 171*b* extending between a top surface 176*b* and a bottom surface 177*b* thereof. In some versions, an inner core 174*b* constructed of a rigid material can be disposed in the bore 171*b*, but this is not necessary. This inner core 174*b* defines a central bore 175*b* having a cylindrical shape. When assembled into the larger system, as will be described, the first portion 170*a* and the second portion 170*b* can be coupled together by inserting the first segment 178*a* of the inner portion 178 of the first portion 170*a* of the bushing assembly 170 into the central bore 175*b* of the second portion 170*b* of the bushing assembly 170. In some versions, the first segment 178*a* of the inner portion 178 is friction fit or otherwise secured into the central bore 175*b*.

In one example, the resilient bushing assembly 170 may be a McMaster-Carr Versa-Mount Vibration-Damping Mount having part number 6309K34. This bushing 170 has a compression capacity of 130 pounds and a total deflection of 0.07" at this maximum compression capacity, a shear force capacity of 50 lbs. with a maximum deflection of 0.02" at this force, an overall height of approximately 1.94", an outer diameter of 1.88", an inner diameter of 0.53", an inner portion 178 outer diameter of 1.30", an inner portion 175 length of 0.56", and an outer bumper 172*a*, 172*b* length of 0.78 inches.

To couple the support member 150 to the system 100, the upper end 153 of the rod 152 is coupled to the receiving end 145 of the vertical support 144 in a manner as previously described. The first segment 178*a* of the inner portion 178 of the first portion 170*a* of the bushing assembly 170 is inserted into the central hole 157*a* formed through the top portion 157 of the hollow coupling member 156, and the second portion 170*b* of the bushing assembly 170*b* is friction fit (or otherwise coupled) onto the first segment 178*a* of the inner portion 178 as described above. That is, the neck or shoulder portion 178*b* of the inner portion 178 may act as a stop for the second portion 170*b*, and may be have an axial dimension equal to the thickness of the top portion 157 of the coupling member 156. Accordingly, the first portion 170*a* of the resilient bushing assembly 170 may rest against the upper surface of the top portion 157. Any number of washers 165, seals, O-rings, or grommets may be disposed between the fasteners 160, 162, the upper portion 157 of the hollow coupling member 156, and the resilient bushing assembly 170.

In this manner, the bushing assembly 170 is effectively coupled to the hollow coupling member 156. Then, the lower end 154 of the rod 152 is inserted through the central bore 175*a* of the first portion 170*a* of the resilient bushing assembly 170, which too extends through the central hole 157*a* in the top portion 157 of the hollow coupling member 156, and then through the central bore 175*b* of the second portion 170*b* of the resilient bushing assembly 170. So configured, the rod 152 is slidably disposed in the bushing assembly 170, which is coupled to the hollow coupling member 156, such that the bushing assembly 170 and hollow coupling member 156 can move relative to the rod 152 and vice versa. A first fastener 160 secures the first portion 170*a* of the resilient bushing assembly 170 to the top portion 157 of the hollow coupling member 156. In the example illustrated in FIGS. 2 and 3, the first fastener 160 is a nut which threadably engages the rod 152. Other examples of suitable fasteners are possible. A second fastener 162 can be used to couple the second portion 170*b* of the resilient bushing assembly 170 to a lower surface of the top portion 157 of the hollow coupling member 156. As seen in FIG. 2, the first and second fasteners 160, 162 limit axial displacement of the rod 152 relative to the bushing assembly 170 and hollow coupling member 156.

Figure 3:
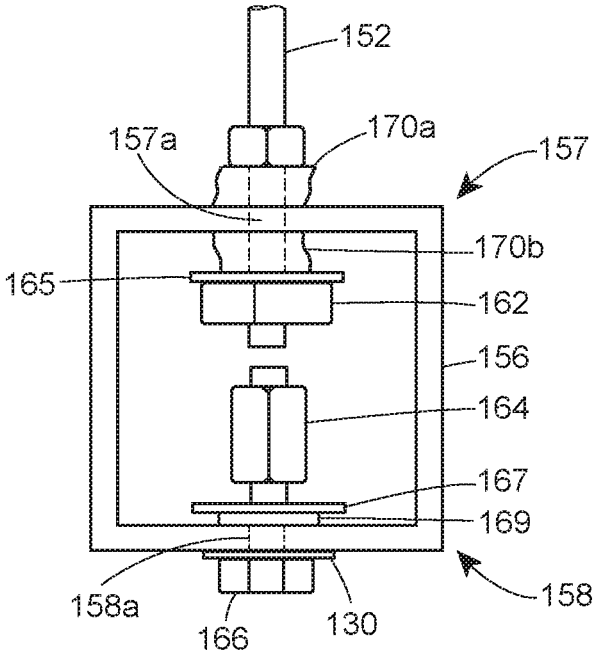
FIG. 3 comprises a front elevation view of the exemplary support member of FIG. 2 upon experiencing material failure of the resilient bushing assembly in accordance with various embodiments of the invention.

As seen in FIG. 3, the lower portion 158 of the hollow coupling member 156 is coupled to a portion of the vibrating plate 130. A plate fastener 166 which, in some embodiments, may be inserted through an opening of the vibrating plate 130 and through the hole 158*a* of the lower portion 158. A fastener 164 may then be used to secure the lower portion 158 to the vibrating plate 130. Any number of washers 167, seals, O-rings, or grommets 169 may be disposed between the fasteners 164, 166, the lower portion 158, and the vibrating plate 130. Any number of additional fasteners 164 or configurations may be used to provide a secure coupling between the vibrating plate 130 and the hollow coupling member 156 such as, for example, via a number of clamping devices. In alternative versions, the hollow coupling member 156 may be secured or affixed to the vibrating plate 130 via any number of approaches such as welding, riveting, and the like. Other examples are possible. Additionally, support washers 165, 167 may be disposed in various positions along the rod 162. So configured, the hollow coupling member 156 is coupled to and supports the vibrating plate 130 in a suspended vertical position.

When the aqueous cementitious slurry is being mixed and pumped along the flow path 109, the motor 132 is engaged to vibrate the vibrating plate 130. As a result, the distribution mat 110, which is supported by the vibrating plate 130, also receives the vibrations. Accordingly, the aqueous cementitious slurry experiences this vibrational force while flowing through the distribution mat 110 towards the opening 111, and as a result, clogging of the distribution mat 110 is minimized due to the constant movement exerted by the vibrating plate 130.

When the vibrating plate 130 vibrates, the vibrational forces are transmitted through the hollow coupling member 156 and are dampened and absorbed by the outer bumper 172*a*, 172*b* of the resilient bushing assembly 170. Accordingly, the vibrational forces are not transmitted along the rod 152 to the overhead bracing system 140, thereby isolating the rod 152, the vertical bracing system 140, and any other components from experiencing vibrations.

Upon operating the system 100 for extended periods of time, the vibrational forces imparted on the resilient bushing assembly 170 may eventually cause some amount of material failure, breaking, or compression of the outer bumper 172*a*, 172*b*. In the event that the outer bumper 172*a*, 172*b* does fail (as illustrated in FIG. 3), the inner core 174*a*, 174*b* (as illustrated in FIG. 4) remains intact and thus will continue to support the hollow coupling member 156 and the vibrating plate 130. The support washer 165 may assist in providing continued support of the hollow coupling member 156 upon failure of the resilient bushing assembly 170 in order to maintain the vertical positioning of the vibrating plate 130. Accordingly, even if the outer bumper 172*a*, 172*b* fails, the version of the support member 150 disclosed herein will continue to suspend the vibrating plate 130 at its original vertical position, and thus will minimize any damage associated with the vibrating plate 130 and/or the distribution mat 110 falling onto the conveyor belt 112 or otherwise moving abruptly.

So configured, each support member 150 is adapted to withstand a force (e.g., a vibrational force, a weight of the vibration plate 130, or any combination of the two) between approximately 5 lbs and approximately 500 lbs. By using multiple support members 150 coupled to the overhead bracing system 140, the cumulative amount of force capable of being supported is proportional to the number of support members 150 in use.

It is understood that while the support member 150 thus far disclosed will continue to support the vibrating plate 130 upon failure or compression of the outer bumper 172*a*, 172*b*, the vibrational forces will not be isolated from the overhead bracing system 140. Accordingly, replacement of the resilient bushing assembly 170 will be desired. The damaged resilient bushing assembly 170 can be easily replaced by uncoupling the support member 150 from the vertical hollow coupling member 156.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A cementitious slurry mixing and dispensing system comprising:

a slurry mixer adapted to agitate a cementitious material and water to form aqueous cementitious slurry;

a discharge conduit in fluid communication with the slurry mixer, the discharge conduit being constructed from a resilient material and forming an interior wall surface defining a slurry flow path adapted to convey aqueous cementitious slurry therethrough to an outlet of the discharge conduit;

a distribution mat disposed proximally to the outlet of the discharge conduit, the distribution mat adapted to evenly distribute the aqueous cementitious slurry onto a moving conveyor belt;

a vibrating plate supporting the distribution mat, the vibrating plate adapted to impart vibrational forces on the distribution mat to promote movement of the aqueous cementitious slurry therethrough;

an overhead bracing system, from which the vibrating plate is suspended; and a plurality of support members coupled between the overhead bracing system and the vibrating plate, each support member comprising a rod, a hollow coupling member, and at least one resilient bushing assembly, an upper end portion of the rod being fixed to the overhead bracing system, a lower end portion of the rod coupled to an upper portion of the hollow coupling member, a lower portion of the hollow coupling member being coupled to the vibrating plate, and the at least one resilient bushing assembly mounted between the lower end portion of the rod and the upper portion of the hollow coupling member;

wherein the at least one resilient bushing assembly is adapted to dampen the vibrational forces exerted by the vibrating plate onto the hollow coupling member, thereby isolating the rod and the overhead bracing system from the vibrational forces.

2. The cementitious slurry mixing and dispensing system of claim 1, wherein the at least one resilient bushing assembly comprises:

an outer bumper constructed of a resilient material and defining an opening therethrough; and an inner core disposed in the opening of the outer bumper, the inner core constructed of a rigid material.

3. The cementitious slurry mixing and dispensing system of claim 2, wherein the at least one resilient bushing assembly further comprises a support washer disposed below the upper portion of the hollow coupling member.

4. The cementitious slurry mixing and dispensing system of claim 1, wherein the resilient bushing assembly comprises a first portion and a second portion distinct from the first portion, the first portion and the second portion being mounted on opposite sides of the upper portion of the hollow coupling member.

5. The cementitious slurry mixing and dispensing system of claim 1, wherein each of the support members is adapted to withstand a force between approximately 5 lbs and approximately 500 lbs.

6. The cementitious slurry mixing and dispensing system of claim 1, wherein the hollow coupling member is coupled to the vibrating plate via a plate fastener.

7. The cementitious slurry mixing and dispensing system of claim 1, wherein the at least one resilient bushing assembly is constructed from at least one of:

(a) a rubber;

(b) a polymer; and (c) a cork material.

8. The cementitious slurry mixing and dispensing system of claim 1, wherein the hollow coupling member has a generally rectangular cross section.

9. The cementitious slurry mixing and dispensing system of claim 1, wherein the hollow coupling member is constructed of a metallic material.

10. The cementitious slurry mixing and dispensing system of claim 1, wherein the rod has an adjustable length of between approximately 3 inches and approximately 30 inches.

11. A support member for a cementitious slurry mixing and dispensing system, the support member comprising:

a rod having an upper end and a lower end, the upper end adapted to be removably fixed to an overhead bracing system;

a hollow coupling member having an upper portion and a lower portion, the lower portion of the hollow coupling adapted to be coupled to a vibrating plate; and at least one resilient bushing assembly mounted between the lower end of the rod and the upper portion of the hollow coupling member;

wherein the at least one resilient bushing assembly is adapted to absorb vibrational forces exerted on the hollow coupling member, thereby isolating the rod from the vibrational forces.

12. The support member of claim 11, wherein the at least one resilient bushing assembly comprises:

an outer bumper constructed of a resilient material and defining an opening therethrough; and an inner core disposed in the opening of the outer bumper, the inner core constructed of a rigid material.

13. The support member of claim 11, wherein the at least one resilient bushing assembly further comprises a support washer disposed below the upper end of the hollow coupling member.

14. The support member of claim 11, wherein the resilient bushing assembly comprises a first portion and a second portion distinct from the first portion, the first portion and the second portion being mounted on opposite sides of the upper portion of the hollow coupling member.

15. The support member of claim 11, wherein the support member is adapted to withstand a force between approximately 5 lbs and approximately 500 lbs.

16. The support member of claim 11, wherein the hollow coupling member is coupled to the vibrating plate via a plate fastener.

17. The support member of claim 11, wherein the at least one resilient bushing assembly is constructed from at least one of:

(a) a rubber;

(b) a polymer; and (c) a cork material.

18. The support member of claim 11, wherein the hollow coupling member has a generally rectangular cross section and includes a plurality of rounded corner portions.

19. The support member of claim 11, wherein the hollow coupling member is constructed of a metallic material.

* * * * *